US008870054B2

(12) United States Patent
Zhou

(10) Patent No.: US 8,870,054 B2
(45) Date of Patent: Oct. 28, 2014

(54) COMPRESSIBLE COMBINED PACKAGING BOX

(76) Inventor: Kui Zhou, Shanghai (CN)

( * ) Notice: Subject to any disclaimer, the term of this patent is extended or adjusted under 35 U.S.C. 154(b) by 311 days.

(21) Appl. No.: 13/394,628

(22) PCT Filed: Sep. 10, 2010

(86) PCT No.: PCT/CN2010/001388

§ 371 (c)(1),
(2), (4) Date: Mar. 7, 2012

(87) PCT Pub. No.: WO2011/032353

PCT Pub. Date: Mar. 24, 2011

(65) Prior Publication Data

US 2012/0168491 A1 Jul. 5, 2012

(30) Foreign Application Priority Data

Sep. 16, 2009 (CN) ..... 2009 2 00748503 U

(51) Int. Cl.

| | |
|---|---|
| ***B65D 5/355*** | (2006.01) |
| ***B65D 21/08*** | (2006.01) |
| ***B65D 77/24*** | (2006.01) |
| ***B65D 77/04*** | (2006.01) |

(52) U.S. Cl.

CPC ..... *B65D 21/08* (2013.01); *B65D 77/245* (2013.01); *B65D 77/0486* (2013.01)

USPC ..... 229/101; 229/400

(58) Field of Classification Search

CPC .... B65D 21/08; B65D 21/086; B65D 21/083; B65D 5/355

USPC ..... 229/101, 4.5, 400, 117.27; 220/666, 6, 220/720, 8, 675, 672, 677; 206/541; 426/111

See application file for complete search history.

(56) References Cited

U.S. PATENT DOCUMENTS 5,002,193 A * 3/1991 Touzani ..... 215/396
6,431,406 B1 * 8/2002 Pruett ..... 222/210

(Continued)

FOREIGN PATENT DOCUMENTS

CN 2839127 Y 11/2006
CN 201124980 Y 10/2008

(Continued)

OTHER PUBLICATIONS

Cao Chuanlu, the International Searching Authority written comments, Dec. 2010, CN.

*Primary Examiner* — Justin Larson
*Assistant Examiner* — Phillip Schmidt
(74) *Attorney, Agent, or Firm* — IPro, Inc.; Na Xu

(57) ABSTRACT

A compressible combined packaging box comprises a threaded cup (1) which includes a threaded zone (1-1) with a stretchable height, a box body (1-2), a support ring (2), an inner bag support piece (3), and an insulated lid (7). The threaded zone (1-1) and the box body (1-2) are an integral molded part; an advertising section (8) is stuck on the outer wall of the box body (1-2), an inwardly concave fixing groove (10) is arranged on the middle part of the box body (1-2), and a hidden picture and text zone (9) is provided on the outer wall of the threaded zone (1-1); the support ring (2) is fixed on the lower edge of the inner wall of the advertising section (8) and is provided with three compressed tabs (2-1) and perforated lines (2-2); and the inner bag support piece (3) is fixed inside the bottom of the box. When the threaded zone (1-1) is elongated upwards, the inner bag support piece (3) is blocked in the fixing groove (10), thus the overall height of the packaging box can be stretched. The packaging box can save the space and cost of storage and transportation, and provide a commercial advertising platform to advertise products.

15 Claims, 5 Drawing Sheets

(56) References Cited

U.S. PATENT DOCUMENTS

| | | | | |
|---|---|---|---|---|
| 2011/0248037 | A1* | 10/2011 | Fung | 220/592.2 |
| 2011/0284547 | A1* | 11/2011 | McElligott et al. | 220/495.03 |
| 2013/0032592 | A1* | 2/2013 | Lee | 220/8 |

FOREIGN PATENT DOCUMENTS

| | | | |
|---|---|---|---|
| CN | 101513944 | A | 8/2009 |
| CN | 201534674 | U | 7/2010 |
| CN | 201534675 | U | 7/2010 |

* cited by examiner

COMPRESSIBLE COMBINED PACKAGING BOX

TECHNICAL FIELD

The invention relates to the technical field of an environmental protection packaging box, and more particularly to a packaging box suitable for brewing food and beverages.

BACKGROUND

At present, many packaging containers for products of known brewing food and beverages (such as instant noodles, milk tea, coffee and the like) are cups and barrels made of PE paper or PP plastic material. The overall height, the inner volume, and the inner space of the containers are not allowed to be pre-compressed and expanded. The height and the inner vacant space of the containers require a great deal of space for storage, transportation, sale, and display, causing high logistic cost and profit loss of enterprises, high consumption of transportation energy, and high exhaust emission which seriously damages the environment.

SUMMARY

To change the situation that the cost of transportation and storage is high because the height, the volume, and the space of the existing packaging containers are not allowed to be pre-compressed, and to improve the structure and optimize the cost of the patent (patent number: 200920064295.3) obtained by the inventor, the invention provides a compressible combined packaging box which adopts the working principle that the spiral grain and clearance of a spring can be compressed and stretched when being formed, and applies the spiral grain principle to the structure of the packaging box. The packaging box can be pre-compressed and mutually stacked and combined, and can be independently used after disassembly and after the height is stretched and the volume is expanded, so that industrialization manufacture is achieved with low cost.

The invention uses the following four technical schemes to solve the technical problems: a threaded cup comprises a threaded zone with a stretchable height, a box body, a support ring, an inner bag support piece, attachment point(s), a connector fixing ring, a box bottom, an insulated lid, an advertising section, a hidden picture and text zone, and a fixing groove. A first technical scheme is as below: the threaded zone with the box bottom, the box body, and the fixing groove are an integrally molded part; the box body is connected with an opening of the insulated lid; the advertising section is arranged on the exterior surface of the outer wall of the box body; the fixing groove is inwardly concave into the box body; the threaded zone is connected with the box bottom; and the hidden picture and text zone is provided on the exterior surface of the outer wall of the threaded zone; the bottom of the inner bag support piece is fixed inside the bottom of the box and provided with two semicircular arc support sheets, and the support ring fixed on the lower edge of the inner wall of the advertising section is provided with three compressed tabs and perforated lines.

A second technical scheme is as below: the threaded zone of the threaded cup, the box body with the box bottom, and the attachment points are an integrally molded part; the threaded zone with a stretchable height is connected with an opening of the insulated lid, and the advertising section is stuck on the exterior surface of the outer wall thereof; the upper part of the outer wall of the box body is provided with three attachment points which are convex upwardly; the lower part of the box body is connected with the box bottom; the hidden picture and text zone is provided on the exterior surface of the outer wall of the box body, and the support ring fixed on the lower edge of the inner wall of the advertising section is provided with three compressed tabs and perforated lines.

A third technical scheme is that: the threaded cup comprises the threaded zone and the box body with the box bottom, which are two independent molded parts; the connector fixing ring is heat sealed and fixed on the lower part of the inner wall of the threaded zone and the upper edge of the outer wall of the box body so that the threaded zone and the box body are stuck into a complete and impermeable packaging box; the threaded zone is connected with the opening of the insulated lid, and the advertising section is arranged on the exterior surface of the outer wall of the threaded zone; the box body is connected with the box bottom, and the hidden picture and text zone is provided on the exterior surface of the outer wall of the box body; the outer wall of the connector fixing ring is provided with three retaining sheets which are convex outwardly; and the support ring fixed on the lower edge of the inner wall of the advertising section is provided with three compressed tabs and perforated lines.

A fourth technical scheme is as below: the packaging box comprises a pre-compressed threaded cup, an outer box, and the insulated lid in a stacking mode; both the threaded cup and the outer box are respectively canned with a share of food, ingredient bag, and tableware; the threaded cup is provided with a thin paper sleeve for isolating printing ink layer and the insulated lid; the threaded cup is stacked in the outer box in which food is canned, and the outer box is sealed with the insulated lid; the advertising section is provided on the outer wall of the outer box, and the hidden picture and text zone is provided on the outer wall of the threaded cup and the surface of the insulated lid; a consumer can pack the food into two shares of individually packaged food to have separate meals.

The packaging box is combined by stacking two threaded cups with a stretched height; the outer empty threaded cup is used as a spare cup; the inner threaded cup is internally provided with two shares of food, ingredient bags, and tableware and is sealed with the insulated lid; a multilayer box lid is sheathed on the inner and outer threaded cups, and the multilayer box lid is provided with a circle of tear line.

The compressible combined packaging box can also be combined by stacking multiple layers (more than two layers) of boxes, as long as one outer box is heightened in proportion to the height of the stacked shares of the built-in threaded cup. After the multiple layer boxes are sheathed, the insulated lid is sealed, and is provided with a multilayer box lid; a consumer can pack the food into multiple shares of individually packaged food to have separate meals.

The packaging box can be molded by PE paper and PP material, can be integrally molded by pulp, and can be molded by combining different materials; the shape of the packaging box can be circular, conical, or trapezoidal.

Advantages of the invention are summarized below: in the process of canning, transporting, storing, exhibiting, and selling products, the overall height of the packaging box is always in a pre-compressed or stacked state; the height is only 60% of that of the existing packaging box of instant noodles and is 50% of that of the packaging box of milk tea; and the inner space of the packaging box is sufficient to contain food, ingredient bags, and tableware when the packaging box is in the compressed or stacked state. When eating, a consumer can stretch the height or split and pack the food into shares to have separate meals; and the space of the packaging can meet the requirement that the packages of the brewing food and beverages should have a large spatial volume. The invention has the advantages of simple operation, safety, sanitation, and long storage time, which can effectively promote the sale of the products, reduce the cost of storage and transportation by 40-50%, reduce the transportation frequency, and promote energy saving and reduce exhaust emissions. Furthermore, the hidden picture and text zone of the inner layer of the packaging box is made into a commercial advertising platform to advertise products, and the potential media dissemination value of the product packaging box is fully displayed, so that the traditional food enterprises create a novel venue for industry development and profit growth.

BRIEF DESCRIPTION OF FIGURES

The invention will further be described in detail in accordance with the figures and the embodiments. However, this invention is not limited to the following contents.

FIG. 6-1 is a three-dimensional front top view of a support ring;

FIG. 6-2 is a sectional view of FIG. 6-1;

FIG. 8-1 is a three-dimensional front top view of a connector fixing ring;

FIG. 8-2 is a sectional view of FIG. 8-1;

FIG. 11-1 is a three-dimensional front top view of a multilayer box lid; and FIG. 11-2 is a sectional view of FIG. 11-1.

Wherein: 1. threaded cup; 1-1. threaded zone; 1-2. box body; 2. support ring; 2-1. compressed tab; 2-2. perforated line; 3. inner bag support piece; 3-1. support sheet; 4. attachment point; 5. connector fixing ring; 5-1. retaining sheet; 6. box bottom; 7. insulated lid; 8. advertising section; 9. hidden picture and text zone; 10. fixing groove; 11. outer box; 12. multilayer box lid; 12-1. tear line; 13. food; 14. ingredient bag; 15. tableware.

DETAILED DESCRIPTION

Figure 1:
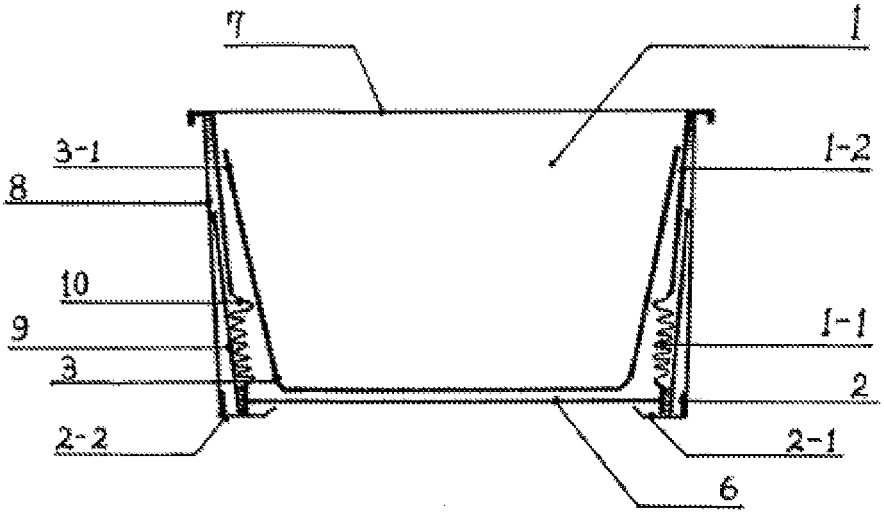
FIG. 1 is a sectional view of a packaging box in a compressed state in a first embodiment of the invention.

In the embodiment shown in FIG. 1, a packaging box is in a compressed state; a threaded cup (1) comprises a threaded zone (1-1) with a stretchable height, a box body (1-2), a support ring (2), an inner bag support piece (3), an insulated lid (7), an advertising section (8), and a hidden picture and text zone (9); wherein the threaded zone (1-1), the box body (1-2) with a box bottom (6), and a fixing groove (10) are a conical integrally molded part; the upper part of the box body (1-2) is connected with an opening of the circular insulated lid (7), and the advertising section (8) is stuck on the exterior surface of the outer wall of the box body (1-2), to label picture and text illustrations for food. A fixing groove (10) that is concave inwardly is arranged on the middle part of the box body (1-2); the lower part of the threaded zone (1-1) is connected with the box bottom (6) which is circular, and the hidden picture and text zone (9) for advertising products is provided on the exterior surface of the outer wall of the threaded zone (1-1); the support ring (2) is fixed on the lower edge of the inner wall of the advertising section (8) and provided with three compressed tabs (2-1) and perforated lines (2-2) which are easy to tear; the inner bag support piece (3) is fixed inside the bottom of the box and provided with two semicircular arc support sheets (3-1), and the top of each support sheet (3-1) is higher than the fixing groove (10) but is lower than the opening of the insulated lid (7) in a compressed state. The threaded cup (1) with a compressed height can satisfy the needs of space for containing food and beverages. That the height and the inner space required by consumers in use are pre-compressed favors cost saving of enterprises.

Figure 2:
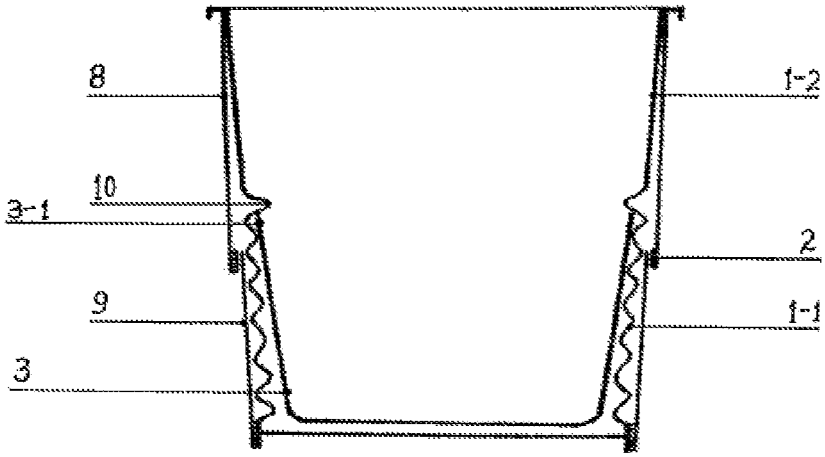
FIG. 2 is a sectional view of a packaging box in a stretched state in the first embodiment of the invention.

In the embodiment shown in FIG. 2, the packaging bag is in a stretched state; the inner bag support piece (3) is blocked in the fixing groove (10). In use, the three compressed tabs (2-1) are torn in accordance with the position of the perforated lines (2-2) and a reversed tension is applied to the packaging box. When the threaded zone (1-1) is elongated upwards, the two support sheets (3-1) are simultaneously blocked in the fixing groove (10), thus the overall height of the packaging box can be stretched and fixed. The requirement of space used for brewing food and beverages after adding hot water can be met. At this moment, the hidden picture and text zone (9) hidden inside the advertising section (8) is displayed as a commercial advertising platform to advertise products. Therefore, the potential media dissemination value of the product packaging box is fully displayed. The packaging box can be molded by PE paper and PP material, can be integrally molded by pulp, and can be molded by mutually combining different material, and the shape of the package can be circular, conical, or trapezoidal.

Figure 3:
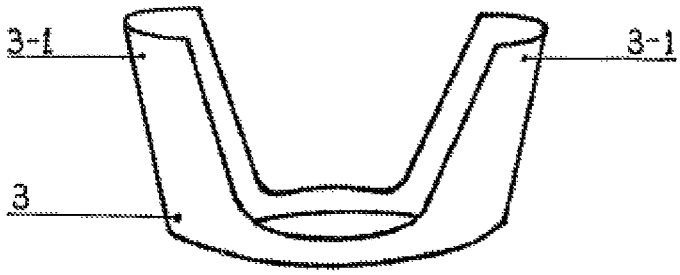
FIG. 3 is a three-dimensional front top view of an inner bag support piece.

In the embodiment shown in FIG. 3, the inner bag support piece (3) is an integrally molded part and provided with two semicircular arc support sheets (3-1) on both sides and a circular inner bag base; each semicircular arc support sheet (3-1) guarantees that the threaded zone (1-1) will not droop after being stretched to a fixed height when the semicircle support sheet (3-1) is fixed in the fixing groove (10), and guarantees that the soup blend flows out smoothly. The shape of the semicircular arc support sheet (3-1) is made in accordance with the shape and size of the packaging box.

Figure 4:
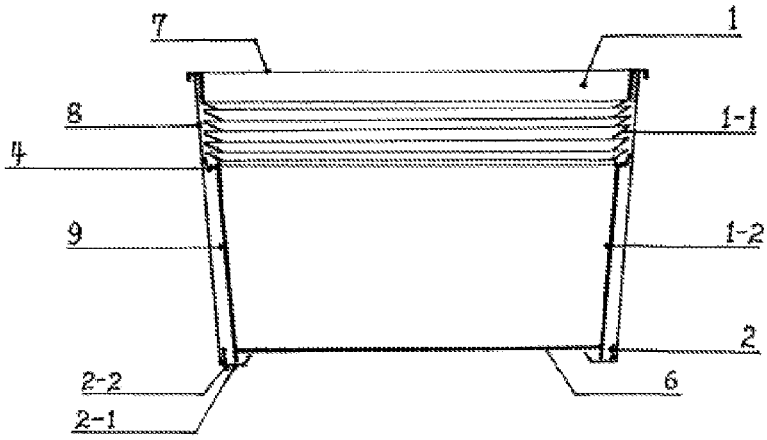
FIG. 4 is a sectional view of a packaging box in a compressed state of a second embodiment of the invention.

In the embodiment shown in FIG. 4, a packaging box is in a compressed state; the packaging box comprises a threaded zone (1-1) with a stretchable height, a box body (1-2), a support ring (2), attachment points (4), an insulated lid (7), an advertising section (8), and an hidden picture and text zone. The threaded zone (1-1), the box body (1-2) with a box bottom (6), and the attachment points (4) are a conical integrally molded part; the upper part of the threaded zone (1-1) is connected with an opening of the insulated lid (7), and the advertising section (8) stuck on the exterior surface of the outer wall of the threaded zone (1-1) labels picture and text illustrations for food; the middle part of the outer wall is provided with three attachment points (4) which are convex upwardly; the lower part of the box body (1-2) is connected with the box bottom (6); the hidden picture and text zone (9) for advertising products hidden inside the advertising section (8) is provided on the outer wall of the box body (1-2); the support ring (2) fixed on the lower edge of the inner wall of the advertising section (8) is provided with three compressed tabs (2-1) and perforated lines (2-2) which are easy to tear; and the shape can be circular, conical, or trapezoidal.

Figure 5:
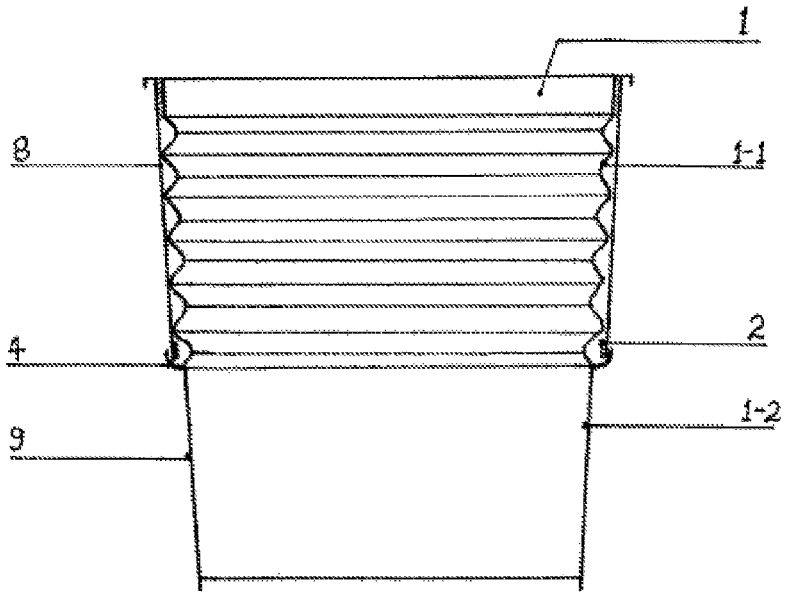
FIG. 5 is a sectional view of a packaging box in a stretched state of the second embodiment of the invention.

In the embodiment shown in FIG. 5, the packaging bag is in a stretched state; the lower part of the advertising section (8) arranged on the middle part of the outer wall of threaded cup (1) and the support ring (2) are supported and fixed in the attachment points (4); in use, the three compressed tabs (2-1) are torn in accordance with the position of the perforated lines (2-2) and a reversed tension is applied to the packaging box. When the threaded zone (1-1) is elongated upwards, the support ring (2) is blocked in the attachment points (4) simultaneously; thus the overall height of the packaging box can be stretched and fixed, and the requirement of space used for brewing food and beverages after adding hot water can be met; at this moment, the hidden picture and text zone (9) hidden inside the advertising section (8) is displayed.

Figures 1, 6:
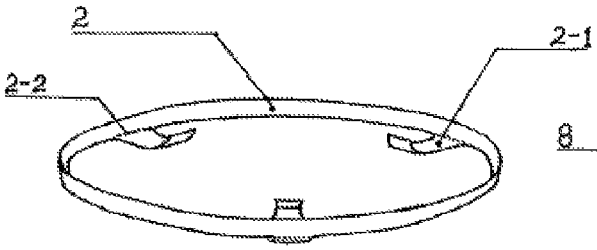
Figures 2, 6:
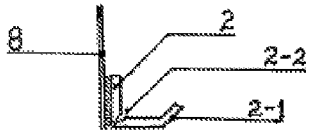

In the embodiment shown in FIG. 6-1, the inner wall of the bottom of the support ring (2) is provided with three compressed tabs (2-1) to control the threaded zone (11) to keep in a compressed state, and each compressed tab (2-1) is provided with a perforated line (2-2) which is easy to tear. FIG. 6-2 is a sectional structure of FIG. 6-1.

Figure 7:
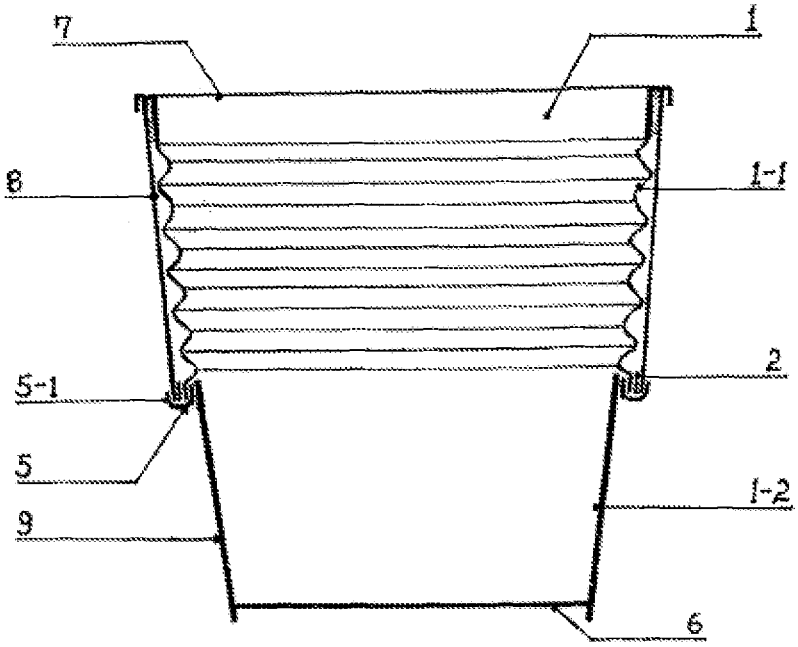
FIG. 7 is a sectional view of a packaging box in a stretched state of a third embodiment of the invention.

In the embodiment shown in FIG. 7, a packaging box is in a stretched state. The packaging box comprises a threaded zone (1-1) with a stretchable height, a box body (1-2), a support ring (2), a connector fixing ring (5), an insulated lid (7), an advertising section (8), and a hidden picture and text zone (9). The threaded zone (1-1) and the box body (1-2) with a box bottom (6) are two independent molded parts. The connector fixing ring (5) is heat sealed and fixed on the inner wall of the lower part of the threaded zone (1-1) and the outer wall of the upper part of the box body (1-2) so that the threaded zone (1-1) and the box body (1-2) are stuck into a complete and impermeable packaging box. The threaded zone (1-1) is connected with an opening of the circular insulated lid (7), and the advertising section (8) for labeling picture and text illustrations for food is arranged on the outer wall of the threaded zone (1-1); the box body (1-2) is connected with the box bottom (6) which is circular, and the hidden picture and text zone (9) for advising products is provided on the surface outer wall of the box body; the bottom of the outer wall of the connector fixing ring (5) is provided with three retaining sheets (5-1) which are convex outwardly. The support ring (2) stuck on the lower edge of the inner wall of the advertising section (8) is provided with three compressed tabs (2-1) and perforated lines (2-2) which are easy to tear. When the perforated lines (2-2) are torn and a reversed tension is applied, the threaded zone (1-1) is elongated upwards, and the support ring (2) is blocked in the retaining sheets (5-1) simultaneously; thus the overall height of the packaging box can be stretched and fixed, and then the requirement of space for brewing food and beverages after adding hot water can be met. The packaging box can be molded by PE paper and PP material, can be integrally molded by pulp, and can be molded by mutually combining different material, and the shape of the packaging box can be circular, conical, or trapezoidal.

Figures 1, 8:
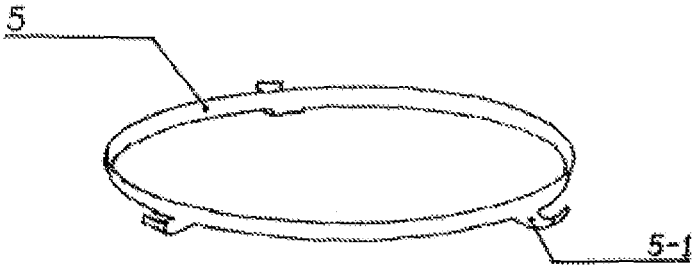
Figures 2, 8:
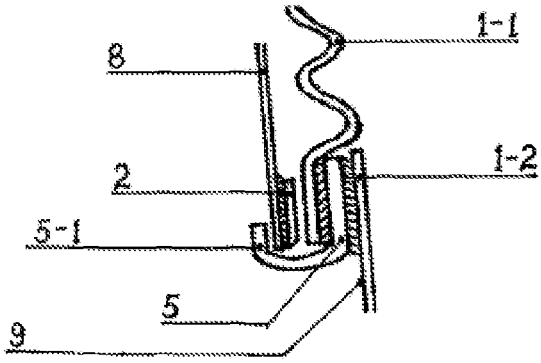

In the embodiment shown in FIG. 8-1, the connector fixing ring (5) is an integrally molded part, has the function of sticking the upper and the lower box bodies into an impermeable pre-compressed threaded cup (1) when being heat sealed and fixed on the lower edge of the inner wall of the threaded zone (1-1) and the upper edge of the outer wall of the box body (1-2). The outer wall of the connector fixing ring (5) is provided with three retaining sheets (5-1) which are convex outwardly. The connector fixing ring (5) further has the function of fixing and supporting the support ring (2) when the height of the thread area (1-1) is stretched. FIG. 8-2 is a sectional structure of FIG. 8-1.

Figure 9:
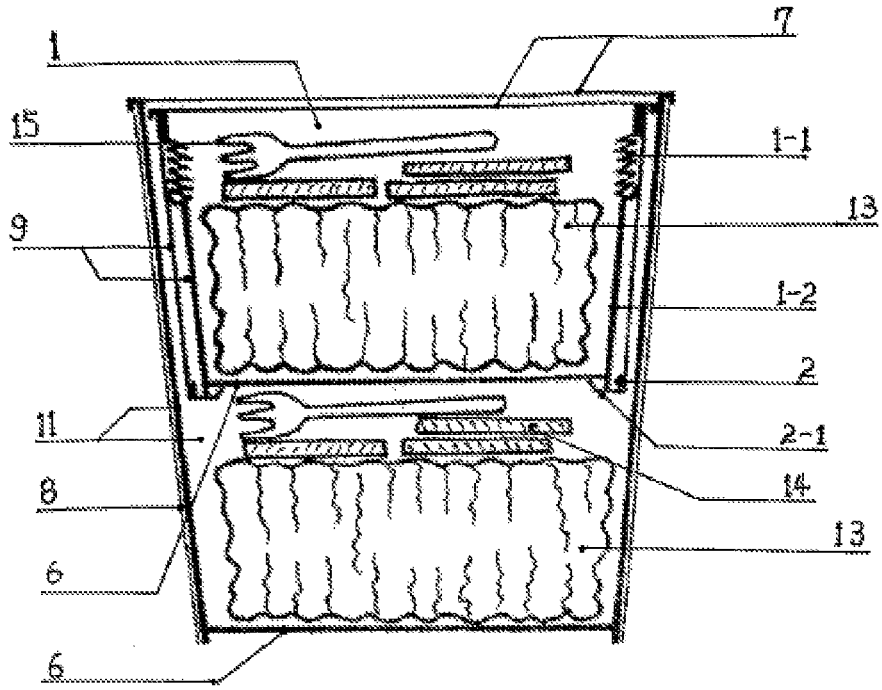
FIG. 9 is a sectional view of a combined packaging box with two stacked boxes of a fourth embodiment of the invention.

In the embodiment shown in FIG. 9, a packaging box is in a combined state of two stacked boxes. The packaging box comprises a pre-compressed threaded cup (1), an outer box (11), an insulated lid (7), an advertising section (8), and a hidden picture and text zone (9). One outer box (11) and one pre-compressed threaded cup (1) are respectively canned with a share of food (13), ingredient bag (14), and tableware (15). The threaded cup (1) is sheathed with a thin paper sleeve for isolating printing ink layer and sealed with the insulated lid (7). The threaded cup (1) is stacked in the outer box (11) in which food is canned, and the outer box (11) is sealed with the sealing lid (7) for sale. The advertising section (8) is arranged on the outer wall of the outer box (11), and the hidden picture and text zone for advertising products is stuck on the surface of the threaded cup (1) and the insulated lid (7) thereof. The compressible combined packaging box can also be combined by stacking multiple layer (more than two layers) boxes, as long as one outer box (11) is heightened in proportion to the height of the stacked shares of the built-in threaded cup (1) and further sealed with the insulated lid (7) after the multiple layer boxes are sheathed. Meanwhile, the packaging box can be achieved in a stacking mode which includes but is not limited to other stacking modes using mutual combination; a consumer can pack the food into two shares or multiple shares of individually packaged food to have separate meals. The invention solves the problems of food safety caused by short storage time, easy pollution, easy moisture after the existing traditional combined packaging box is unpacked, and has the advantages of simple operation, effective promotion of products, and effective reduction of the cost of storage and transportation. The hidden picture and text zone (9) provides a commercial advertising platform to advertise products, and the potential media dissemination value of the product packaging box is fully displayed. The packaging box can be molded by PE paper and PP material, can be integrally molded by pulp, and can be molded by mutually combining different material, and the shape of the package can be circular, conical, or trapezoidal.

Figure 10:
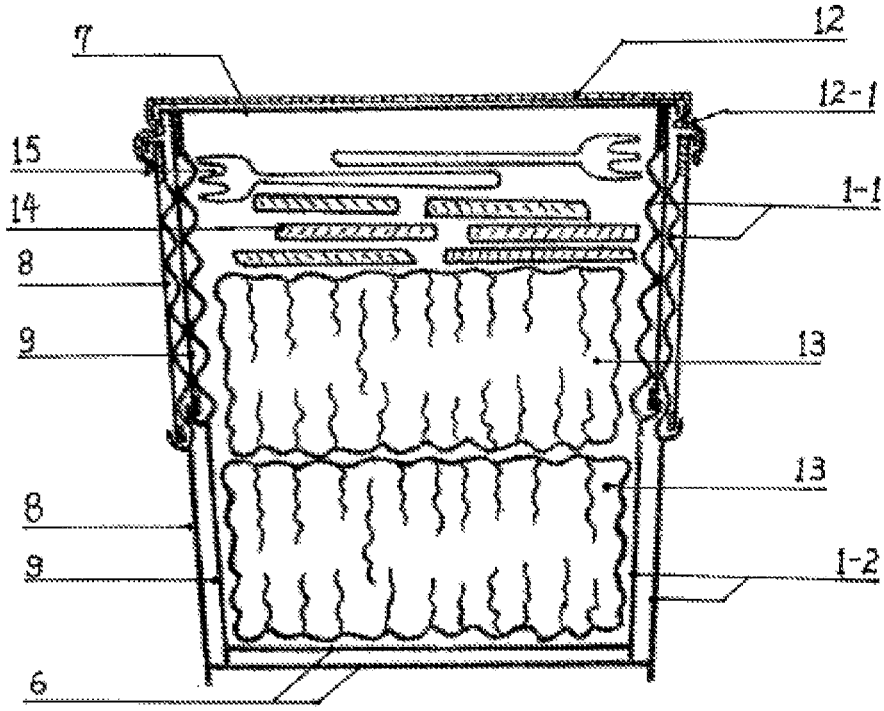
FIG. 10 is a sectional view of another combined packaging box with two stacked boxes of the fourth embodiment.

In the embodiment shown FIG. 10, the packaging box is in a combined state of two stacked threaded cups (1) with a stretched height. One threaded cup (1) with a stretched height is canned with two shares of food (13), ingredient bags (14), and tableware (15), sheathed with a thin paper sleeve for isolating printing ink layer, and sealed with the insulated lid (7). Another empty threaded cup (1) with a stretchable height is sheathed and stacked for use. Thereafter, the threaded cup (1) is sealed by a multilayer box lid (12) for sale. Optionally, the packaging box can be achieved in a stacking mode which includes but is not limited to the following stacking mode: one threaded cup (1) in a compressed state is canned with a share of food and sheathed in another stretched height threaded cup (1) canned with food after being sealed with the insulated lid (7). The packaging box has advantages of simple operation, effective reduction of the cost of storage and transportation, and effective promotion of products. A consumer can pack the food into two shares of individually packaged food to have separate meals.

Figures 1, 11:
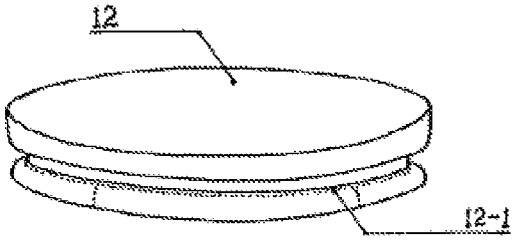
Figures 2, 11:
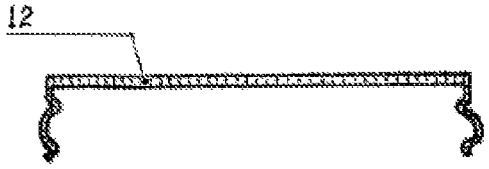

In the embodiment shown in FIG. 11-1, the multilayer box lid (12) used when the packaging box is combined by stacking two layer threaded cups (1) is an integrally molded part and provided with a layer of tear line (12-1) capable of being torn after the consumer uses, to guarantee convenient use and sanitation. The number of layers of the multilayer box lid (12) and the tear line (12-1) can be simultaneously increased in accordance with the number of stacking layers, and the shape and size of the multilayer box lid (12) are made in accordance with the shape and size of the packaging box. FIG. 11-2 is a sectional view of FIG. 11-1.

I claim:

1. A compressible combined packaging box, comprising: a support component for keeping a stretched threaded zone in a stretched state, a box body, and a threaded zone with a stretchable height which is connected with the box body; a top opening of said compressible combined packaging box is provided with an insulated lid; a support ring is fixed around the bottom, and an advertising section is fixed between the support ring and the insulated lid; wherein a body of said support ring is provided with compressed tabs; one end of each compressed tab fixed on the body of said support ring is provided with a perforated line, and the other end of said compressed tab is fixed on the bottom of the compressible combined packaging box.

2. The compressible combined packaging box of claim 1, wherein one end of said box body is connected with said threaded zone, the other end of said box body is connected with said insulated lid, and the other end of said threaded zone is fixed on the box bottom; one end of said threaded zone near said box body is provided with a fixing groove that is inwardly convex to the compressible combined packaging box, an inner bag support piece is arranged inside said compressible combined packaging box, the periphery of said inner bag support piece is provided with vertical support sheets for butting the fixing groove, and said support component is formed by said inner bag support piece and said fixing groove.

3. The compressible combined packaging box of claim 2, wherein a hidden picture and text zone is arranged between said advertising section and said threaded zone, and one end of said hidden picture and text zone is fixedly surrounded on the bottom of said compressible combined packaging box.

4. The compressible combined packaging box of claim 2, wherein said box body and said threaded zone are an integrally molded part.

5. The compressible combined packaging box of claim 1, wherein one end of said threaded zone is connected with said insulated lid, the other end of said threaded zone is connected with one end of said box body, and the other end of said box body is fixed on the box bottom; said box body is provided with attachment points which are outwardly convex and are used for supporting the bottom of the advertising section after the threaded zone is stretched, and said support piece is formed by said attachment points and said advertising section.

6. The compressible combined packaging box of claim 5, wherein the hidden picture and text zone is arranged around said box body.

7. The compressible combined packaging box of claim 5, wherein, said attachment points, said box body and said threaded zone are an integrally molded part.

8. The compressible combined packaging box of claim 1, wherein said compressible combined packaging box also comprises a fixing ring; one end of said threaded zone is connected with said insulated lid, the other end of said threaded zone is connected with one end of said box body through the fixing ring, and the other end of said box body is fixed on the box bottom; said fixing ring is provided with retaining sheets which are outwardly convex and are used for supporting the bottom of the advertising section after the threaded zone is stretched, and said support piece is formed by said retaining sheets and said advertising section.

9. The compressible combined packaging box of claim 8, wherein said box body and said threaded zone are respectively stuck on the inside and the outside of said fixing ring.

10. The compressible combined packaging box of claim 8, wherein the hidden picture and text zone is arranged around said box body.

11. A stacked combined packaging box, comprising: an outer packaging box; wherein the inside of said outer packaging box comprises at least one compressible combined packaging box;

said compressible combined packaging box comprises: a support component for keeping a stretched threaded zone in a stretched state, a box body, and a threaded zone with a stretchable height which is connected with the box body; a top opening of said compressible combined packaging box is provided with an insulated lid, a support ring is fixed around the bottom, and an advertising section is fixed between the support ring and the insulated lid.

12. The stacked combined packaging box of claim 11, wherein said outer packaging box is the compressible combined packaging box;

said compressible combined packaging box comprises: a support component for keeping a stretched threaded zone in a stretched state, a box body, and a threaded zone with a stretchable height which is connected with the box body; a top opening of said compressible combined packaging box is provided with an insulated lid, a support ring is fixed around the bottom, and an advertising section is fixed between the support ring and the insulated lid.

13. The stacked combined packaging box of claim 11, wherein said compressible combined packaging box is in a compressed state.

14. The stacked combined packaging box of claim 11, wherein said compressible combined packaging box is in a stretched state.

15. The stacked combined packaging box of claim 14, wherein the sealing part of said stacked combined packaging box is provided with a multilayer box lid; the number of the layers of said multilayer box lid is consistent with the number of the stacked layers of said stacked combined packaging box, and the layers of said multilayer box lid are tightly connected by the tear line.

* * * * *